US005676033A

United States Patent [19]

Szabo

[11] Patent Number: 5,676,033

[45] Date of Patent: Oct. 14, 1997

[54] PNEUMATIC DRIVE DEVICE

[76] Inventor: Zsolt Szabo, Reginoltstr. 17, 80933 Munchen, Germany

[21] Appl. No.: 643,796

[22] Filed: May 7, 1996

[30] Foreign Application Priority Data

May 9, 1995 [DE] Germany ..... 195-16977.8-53

[51] Int. Cl.[6] ..... F01L 25/02; F01L 31/00

[52] U.S. Cl. ..... 91/303; 91/316; 91/327; 91/329; 91/348

[58] Field of Search ..... 91/218, 303; 327, 91/329, 348, 533

[56] References Cited

U.S. PATENT DOCUMENTS

| | | | |
|---|---|---|---|
| 2,818,022 | 12/1957 | Kangas | 91/348 X |
| 3,606,818 | 9/1971 | Hirn | 91/348 X |
| 4,033,134 | 7/1977 | Bentley | 91/348 X |
| 4,174,928 | 11/1979 | Austin | 91/348 X |
| 4,364,303 | 12/1982 | Sumida | 91/348 X |
| 4,759,260 | 7/1988 | Lew | 91/533 X |
| 5,470,209 | 11/1995 | Hartley et al. | 91/348 X |

*Primary Examiner*—Hoang Nguyen

*Attorney, Agent, or Firm*—Anthony J. Casella; Gerald E. Hespos; Ludomir A. Budzyn

[57] ABSTRACT

There is disclosed a pneumatic driving device having a cylindrical housing in which a piston element is axially displaceable. The piston element has at its ends a front piston and a rear piston which are connected to each other by a connecting pipe. A switch element is mounted in the housing between the pistons and defines a variable front chamber with the front piston and a variable rear chamber with the rear piston. Two inlet openings acted on by pressure are formed in the housing and can be connected with the front and rear chambers respectively. The switch element, in a first position, frees the inlet opening to the rear chamber so that the rear piston travels axially outward and the front piston axially inward and, in a second position, frees the inlet opening to the front chamber so that the front piston moves axially outward and the rear piston axially inward. The inwardly moving pistons reverse the switch element between the two positions.

10 Claims, 1 Drawing Sheet

PNEUMATIC DRIVE DEVICE

BACKGROUND OF THE INVENTION

1. Field of the Invention

The present invention relates to a pneumatic driving device.

2. Description of the Prior Art

Large, cumbersome pneumatic driving devices are already known which operate effectively only at pressures above 5 bar and, because of this, require good insulation of the pressure conducting lines. Such pneumatic driving devices are heavy, cumbersome, and mechanically expensive.

The object of the present invention is to provide a pneumatic driving device which is of simple mechanical construction and operates satisfactorily even at lower pressures.

SUMMARY OF THE INVENTION

In accordance with the invention, there is provided a pneumatic driving device which has a cylindrical housing in which a piston element is guided for axial displacement. The piston element has on its ends a front piston and a rear piston. The pistons are connected to each other by a connecting pipe. A switch element is mounted in the housing between the pistons and defines a variable front chamber with the front piston and a variable rear chamber with the rear piston. Two inlet openings, which can be acted on by pressure, are formed in the housing and can be connected with the front and rear chambers respectively. The switch element, in a first position, frees the inlet opening to the rear chamber so that the rear piston travels axially outward and the front piston axially inward and, in a second position, frees the inlet opening to the front chamber so that the front piston moves axially outward and the rear piston axially inward. The inwardly moving piston in each case switches the switch element between the two positions.

By the invention there is created a pneumatic driving device of universal use, the pistons of which alternately carry out outwardly directed blows or impulses in a given frequency. The strength of the blows can be adjusted by the dimensioning of the pressure fed and the dimensions of the structural parts. The reversing of the direction of movement of the pistons, which are coupled to each other, is effected by a switch element which is positively controlled by the piston element and alternately opens the chambers associated with the piston to pressure, the rearward moving piston switching the switch element. The simple mechanical development creates a pneumatic driving device of structurally simple construction, the parts of which are guided pneumatically so that lubrication is unnecessary.

The mounting on air cushions minimizes the loss of energy by friction. The pneumatic driving device employs air-mounted twin pistons which are positively controlled by the switch element. The energy introduced by the pressure is continuously effectively converted without loss. Due to the air mounting, low frictional losses are present so that substantially better efficiency can be obtained than with a traditional driving device. The pneumatic driving device of the invention can be universally employed for all impulse-controlled or blow-controlled driving problems. It can be used to particular advantage for the implanting and removal of prostheses and bone nails or for medical rasps and saws, particularly for prosthetic purposes.

It is preferred that the switch element have two radial sealing lips which serve for the alternate closing of the inlet openings. The radial sealing lips serve, on the one hand, to form the front and rear chambers which are present between the corresponding radial sealing lip and the piston inner surface. On the other hand, the radial sealing lips, in a second function, serve for closing the inlet openings. This double function is space-saving and reduces the total number of structural parts required.

It is furthermore preferred that the distance between the two radial sealing lips be less than the distance between the inlet openings. In this way a favorable alternate closing of the inlet openings is possible.

The connecting pipe has at least one front take-off opening for the venting of the front chamber and at least one rear take-off opening for the venting of the rear chamber. This facilitates the return movement of the corresponding piston, as a result of which the volume containing the corresponding chamber is led away.

The connecting pipe is preferably passed through the switch element so that the two elements axially guide each other. In this way, the number of structural parts and the space required is also reduced. The pistons have passage openings formed at their end for the residual venting. As an alternative, or in addition, passage openings formed in the housing can also be provided in order to support the residual venting. Furthermore, it is possible to provide a sufficiently dimensioned annular slot between piston and cylinder, which slot assures the residual venting of the corresponding cylinder chamber. In order also suitably to remove the residual volume contained in the corresponding chamber, passage openings are formed at the end side in the piston. They supplement the action of the take-off openings arranged in the connecting pipe.

The connecting pipe is preferably passed through the pistons and is open at the end.

Other advantages and possible uses of the present invention will become evident from the following description of an embodiment, read with reference to the drawings.

DETAILED DESCRIPTION OF THE PREFERRED EMBODIMENT

Figure 1:
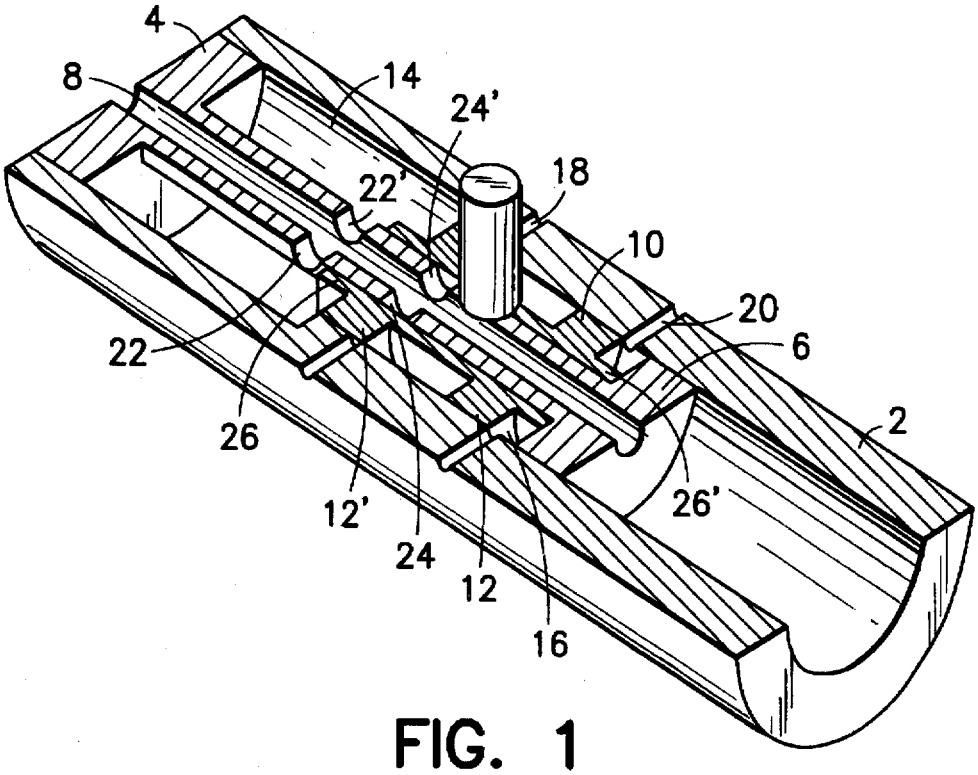
FIG. 1 is a perspective view of an embodiment, half broken away, of a pneumatic driving device in accordance with the invention.

The pneumatic driving device shown in the figures has a housing 2 which has two sections of different inside diameter. The outside diameter of the housing is the same over the entire length. The different dimensioning of the section cross-sections or piston cross-sections permits the adjustment of the amplitude of the impulses in the direction in question so that different impulse amplitudes can be set. The two sections can alternatively have the same diameter.

In the section of housing 2 of larger inside diameter there is an axially displaceably supported front piston 4, while in the section of the housing 2 of smaller diameter there is a correspondingly smaller rear piston 6. The two pistons 4 and 6 are connected to each other by an internally hollow connecting pipe 8 and therefore carry out movements in common.

Approximately at the center of the housing 2 there is arranged a switch element 10 which serves for the alternate action of pressure on the two pistons 4 and 6. The switch element 10 has two sealing lips 12, 12' which are spaced axially from each other, both of which are located in the housing section of smaller diameter. Between the front sealing lip 12' and the front piston 4 arranged opposite it, there is a front chamber 14 which serves as pressure-actuation chamber for the piston 4. Between the rear sealing lip 12 and the rear piston 6 arranged opposite it there is a rear chamber 16 which serves as pressure-actuation chamber for the piston 6.

In the housing 2, namely in the section of smaller diameter, there are two inlet openings 18, 20 spaced axially from each other which serve for the pressure actuation for the two chambers 14 and 16. The two inlet openings 18, 20 empty in the region of the axially displaceably mounted switch element 10.

Figure 2:
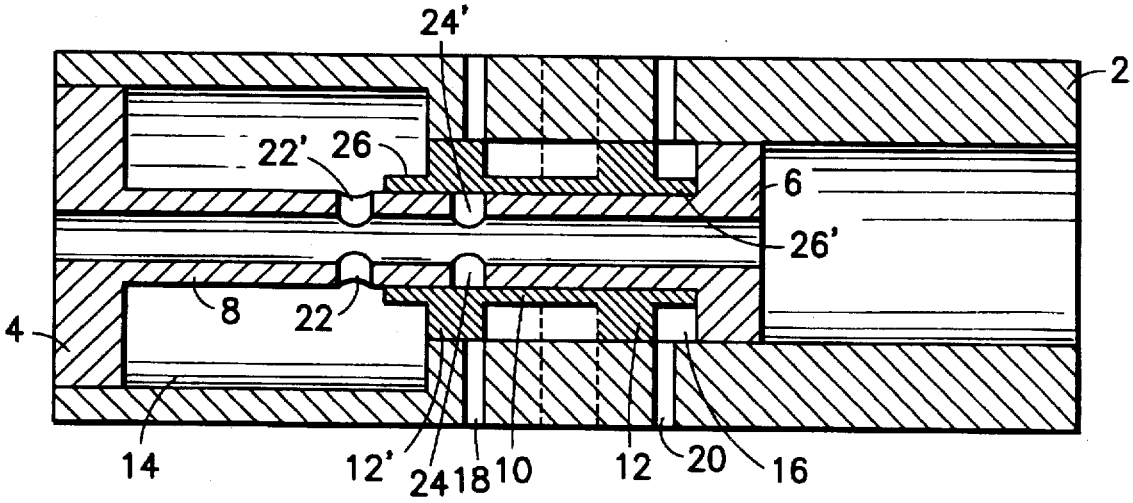
FIG. 2 is a cross-section through the embodiment of FIG. 1.

The switch element 10 is so developed and installed that it is displaceable between a first, left-hand position shown in FIG. 2 and a second position (not shown). In the first position shown in FIG. 2, the inlet opening 18 to the front chamber 14 is blocked by the sealing lip 12' so that the chamber 14 cannot be acted on by pressure. On the other hand, in this first position, the inlet opening 20 is connected to the rear chamber 16. The two inlet openings 18, 20 are connected to a source of pressure so that the pressure fluid flowing into the chamber 16 moves the piston 6 outward, while the volume of the chamber 16 is increased. Since the two pistons 4 and 6 are coupled, the piston 4 carries out a similarly inwardly directed movement. The axially outer end of the switch element 10 is formed by a sleeve 26 against which the piston 4 strikes upon its return movement. The piston 4 by coming against the sleeve 26 moves the switch element out of a first position (shown at the left in FIG. 2) into the second position (not shown), in which the inlet opening 18 to the front chamber 14 is opened, while the inlet opening 20 to the rear chamber 16 is now closed. The pressure line connected to the inlet opening 18 conducts pressure fluid into the front chamber 14 which thereby expands, as a result of which the piston 4 is driven outward. At the same time, the piston 6 carries out an inward directed movement which, in the last third of the movement, brings it to rest against a sleeve 26' formed on the end side in the switch element 10. The backward moving piston 6, by coming against the sleeve 26', pushes the switch element 10 back from its second position into its first position (shown in FIG. 2).

The alternate action of the two pistons 4 and 6 described leads to a reciprocating movement of the two pistons. Each of the two pistons can be used as pneumatic driving device. In the connecting pipe 8, two take-off openings 22, 22' are formed for the opening in the chamber 14, they serving for the removal of the pneumatic volume contained in the chamber 14. For this purpose, the connecting pipe 8 is passed through the piston 4 and opens at the outer end surface thereof. Similarly, for the opening in the rear chamber 16 there are formed two rear take-off openings 24, 24' arranged opposite each other which serve for removing fluid from the rear chamber 16 upon the contraction thereof. The connecting pipe 8 is also passed through the piston 6 and opens on the outer end surface thereof. For the residual venting, passage openings formed at the end in the two pistons 4, 6, or a slot formed between cylinder and piston are provided which serve for the residual venting. They cooperate suitably with the take-off openings 22, 22' and 24, 24' respectively.

What is claimed is:

1. A pneumatic driving device actuated by at least two pressurized gas lines, said driving device comprising a cylindrical housing (2) within which a piston element (4, 6, 8) is guided for axial displacement, the piston element having opposed ends formed respectively with a front piston (4) and a rear piston (6) which are connected to each other by a connecting pipe (8), a switch element (10) which is mounted in the housing (2) between the pistons (4, 6) and which defines a variable front chamber (14) with the front piston (4), and a variable rear chamber (16) with the rear piston (6) and at least two inlet openings (18, 20) formed in the housing (2) which can be connected with the front and rear chambers respectively, each said inlet opening being in communication with at least one said pressurized gas line, wherein the switch element (10), in a first position, freeing the inlet opening (20) to the rear chamber so that the rear piston (6) travels axially outward and the front piston (4) axially inward, and, in a second position, freeing the inlet opening (18) to the front chamber (14) so that the front piston (4) moves axially outward and the rear piston (6) moves axially inward, the inwardly moving piston (4, 6) switching the switch element (10) between the two positions.

2. A pneumatic driving device according to claim 1, characterized by the fact that the switch element (10) has two radial sealing lips (12, 12') which alternately open and close the inlet openings.

3. A pneumatic driving device according to claim 1, characterized by the fact that the distance between the sealing lips (12, 12') is less than the distance between the inlet openings (18, 20).

4. A pneumatic driving device according to claim 3, characterized by the fact that the connecting pipe (8) has at least one front take-off opening (22, 22') for the venting of the front chamber (14) and at least one rear take-off opening (24, 24') for the venting of the rear chamber (16).

5. A pneumatic driving device according to claim 4, characterized by the fact that the connecting pipe (8) is passed through the switch element (10).

6. A pneumatic driving device according to claim 5, characterized by the fact that the pistons have passage openings formed on the end for the residual venting.

7. A pneumatic driving device according to claim 4, characterized by the fact that the connecting pipe (8) is passed axially through the pistons (4, 6) and is open at the end.

8. A pneumatic driving device according to claim 1, characterized by the fact that the housing (2) has passage openings for the residual venting.

9. A pneumatic driving device comprising:

a tubular housing having first and second ends and a passageway extending therebetween;

a first piston slidably disposed in said passageway;

a second piston slidably disposed in said passageway between said first piston and said second end of said housing;

a connecting pipe rigidly connected to said first and second pistons and extending therebetween such that said pistons and said pipe move in unison in said passageway;

a first pressurized gas line extending through said housing and into said passageway;

a second pressurized gas line extending through said housing and into said passageway at a location between said first pressurized gas line and said second end of said housing; and a switch slidably disposed in said passageway and surrounding said pipe for slidable movement relative to said pistons, said switch having a first end selectively engageable by said first piston for slidable movement with said first piston away from said first end of said housing and into a first position, said switch further having a second end selectively engageable by said second piston for slidable movement with said second piston away from said second end of said housing and into a second position, said switch being configured to define a first chamber between said switch and said first piston and a second chamber between said switch and said second piston, volumes of said chambers being variable in accordance with movement of said pistons relative to said switch, said switch being configured for blocking said first pressurized gas line and for permitting gas communication between said second pressurized gas line and said second chamber when said switch is in said second position, said switch further being configured for blocking said second pressurized gas line and for permitting gas communication from said first pressurized gas line to said first chamber when said switch is in said first position.

10. The pneumatic driving device of claim 9, wherein said connecting pipe is hollow and provides communication to locations externally of said housing, said connecting pipe further having at least two axially spaced take-off openings disposed relative to said chambers for selectively exhausting pressurized gas therefrom.

* * * * *